United States Patent [19]

Chang et al.

[11] Patent Number: 4,542,247

[45] Date of Patent: Sep. 17, 1985

[54] CONVERSION OF LPG HYDROCARBONS TO DISTILLATE FUELS OR LUBES USING INTEGRATION OF LPG DEHYDROGENATION AND MOGDL

[75] Inventors: Clarence D. Chang; Joe E. Penick, both of Princeton; Richard F. Socha, Trenton, all of N.J.

[73] Assignee: Mobil Oil Corporation, New York, N.Y.

[21] Appl. No.: 650,473

[22] Filed: Sep. 14, 1984

[51] Int. Cl.[4] ..... C07C 5/00; C07C 1/00

[52] U.S. Cl. ..... 585/254; 585/255; 585/330; 585/517; 585/533; 585/654

[58] Field of Search ..... 585/254, 255, 330, 517, 585/533, 654

[56] References Cited

U.S. PATENT DOCUMENTS

| | | | |
|---|---|---|---|
| 3,960,978 | 6/1976 | Givens et al. | 260/683.15 R |
| 4,021,502 | 5/1977 | Plank et al. | 260/683.15 R |
| 4,100,218 | 7/1978 | Chen et al. | 260/673 |
| 4,150,062 | 4/1979 | Garwood et al. | 260/673 |
| 4,191,846 | 3/1980 | Farha, Jr. et al. | 585/440 |
| 4,197,185 | 4/1980 | LePage et al. | 208/71 |
| 4,211,640 | 7/1980 | Garwood et al. | 208/255 |
| 4,227,992 | 10/1980 | Garwood et al. | 208/46 |
| 4,268,701 | 5/1981 | Vu et al. | 585/331 |
| 4,270,929 | 6/1981 | Vu et al. | 585/331 |
| 4,304,948 | 12/1981 | Vora et al. | 585/330 |
| 4,341,911 | 7/1982 | Vora et al. | 585/331 |
| 4,393,259 | 7/1983 | Ward et al. | 585/330 |
| 4,413,153 | 11/1983 | Garwood et al. | 585/304 |
| 4,433,185 | 2/1984 | Tabak | 585/312 |
| 4,456,781 | 6/1984 | Marsh et al. | 585/533 |

OTHER PUBLICATIONS

Kirk-Othmer, *Encyclopedia of Chemical Technology,* 3d Ed., vol. 19, "Powder Coatings to Recycling", pp. 232-235 (Propylene); John Wiley & Sons, 1979.

*Oil & Gas Journal*-Dec. 8, 1980, "Dehydrogenation Links LPG to More Octanes", pp. 96-101; S. Gussow et al., Houdry Div., Air Products & Chemicals, Inc., Allentown, Pa.

*Hydrocarbon Processing,* Apr. 1982, "$C_2/C_5$ Dehydrogenation Updated" by B. V. Vora and T. Imai, UOP Inc., Des Plaines, Ill., pp. 171-174.

*Primary Examiner*—Curtis R. Davis

*Attorney, Agent, or Firm*—Alexander J. McKillop; Michael G. Gilman; Dennis P. Santini

[57] ABSTRACT

Disclosed is a method and apparatus for producing distillate and/or lubes which employ integrating catalytic (or thermal) dehydrogenation of paraffins with MOGDL. The process feeds the product from a low temperature propane and/or butane dehydrogenation zone into a first catalytic reactor zone, which operates at low pressure and contains zeolite oligomerization catalysts, where the low molecular weight olefins are reacted to primarily gasoline range materials. These gasoline range materials can then be pressurized to the pressure required for reacting to distillate in a second catalytic reactor zone operating at high pressure and containing a zeolite oligomerization catalyst. The distillate is subsequently sent to a hydrotreating unit and product separation zone to form lubes and other finished products.

11 Claims, 1 Drawing Figure

CONVERSION OF LPG HYDROCARBONS TO DISTILLATE FUELS OR LUBES USING INTEGRATION OF LPG DEHYDROGENATION AND MOGDL

BACKGROUND OF THE INVENTION

1. Field of the Invention

This invention relates to a method and apparatus for converting paraffins to lubes and other higher hydrocarbons, such as gasoline range or distillate range fuels. In particular, it relates to methods and apparatus which combine the operation of catalytic (or thermal) dehydrogenation of a paraffinic feedstock to produce olefins and the operation of a two-stage catalytic reactor system to convert olefins to gasoline and distillate boiling range materials, and downstream units to recover lubes from the distillate.

2. Discussion of the Prior Art

It has been established that the conversion of paraffins, such as propane and butane, to mono-olefins, such as propylene and butylene, can be accomplished by thermal or catalytic dehydrogenation. A general discussion of thermal dehydrogenation (i.e., steam cracking) is presented in *Encyclopedia of Chemical Technology*, Ed. by Kirk and Othmer, Vol. 19, 1982, Third Ed., pp. 232–235. Various processes for catalytic dehydrogenation are available in the prior art. These processes include the Houdry Catofin process of Air Products and Chemicals, Inc., Allentown, Pa., the Oleflex process of UOP, Inc., Des Moines, Ill. and a process disclosed by U.S. Pat. No. 4,191,846 to Farha, Jr. et al. The Houdry Catofin process, described in a magazine article, "Dehydrogenation Links LPG to More Octanes", Gussow et al, *Oil and Gas Journal*, Dec. 8, 1980, involves a fixed bed, multi-reactor catalytic process for conversion of paraffins to olefins. Typically, the process runs at low pressures of 5–30 inches of mercury absolute, and high temperatures with hot reactor effluent at 550°–650° C. Dehydrogenation is an endothermic reaction, so it normally requires a furnace to provide heat to a feed stream prior to feeding the feed stream into the reactors. The UOP Oleflex process, disclosed in an article "$C_2/C_5$ Dehydrogenation Updated ", Verrow et al, *Hydrocarbon Processing, April* 1982, used stacked catalytic reactors. U.S. Pat. No. 4,191,846 to Farha, Jr. et al teaches the use of group VIII metal containing catalysts to promote catalytic dehydrogenation of paraffins to olefins.

Recent developments in zeolite catalysts and hydrocarbon conversion methods and apparatus have created interest in utilizing olefinic feedstocks for producing heavier hydrocarbons, such as $C_5$+ gasoline, distillate or lubes. These developments have contributed to the development of the Mobil olefins to gasoline/distillate (MOGD) method and apparatus, and the development of the Mobil olefins to gasoline/distillate/lubes (MOGDL) method and apparatus.

In MOGD and MOGDL, olefins are catalytically converted to heavier hydrocarbons by catalytic oligomerization using an acid crystalline zeolite, such as a ZSM-5 type catalyst. Process conditions can be varied to favor the formation of either gasoline or distillate range products. In U.S. Pat. Nos. 3,960,978 and 4,021,502, Plank, Rosinski and Givens disclose conversion of $C_2$–$C_5$ olefins, alone or in combination with paraffinic components, into higher hydrocarbons over a crystalline zeolite catalyst. Garwood et al have contributed improved processing techniques to the MOGD system, in U.S. Pat. Nos. 4,150,062; 4,211,640; and 4,227,992. Marsh et al, in U.S. Pat. No. 4,456,781, have also disclosed improved processing techniques for the MOGD system. U.S. Pat. No. 4,433,185 to Tabak teaches conversion of olefins in a two-stage system over a ZSM-5 or ZSM-11 zeolite catalyst to form gasoline or distillate.

Olefinic feedstocks may be obtained from various sources, including from fossil fuel processing streams, such as gas separation units, from the cracking of $C_2$+ hydrocarbons, such as LPG (liquified petroleum gas), from coal by-products and from various synthetic fuel processing streams. U.S. Pat. No. 4,100,218 (Chen et al) teaches thermal cracking of ethane to ethylene, with subsequent conversion of ethylene to LPG and gasoline over a ZSM-5 type zeolite catalyst.

The conversion of olefins in a MOGDL system may occur in a gasoline mode and/or a distillate/lube mode. In the gasoline mode, the olefins are catalytically oligomerized at temperature ranging from 400°–800° F. and pressure ranging from 10–1000 psia. To avoid excessive temperatures in th exothermic reactor, the olefinic feed may be diluted. In the gasoline mode, the diluent may comprise light hydrocarbons, such as $C_3$–$C_4$, from the feedstock and/or recycled from debutanized product. In the distillate/lube mode, olefins are catalytically oligomerized to distillate at temperature ranging from 350°–600° F. and pressure ranging from 100–3000 psig. The distillate is then upgraded by hydrotreating and separating the hydrotreated distillate to recover lubes.

Although distillate and lubes can be produced from propane and butane by the prior art, using dehydrogenation integrated with MOGDL, there are several problems with integrating these processes. For example, U.S. Pat. No. 4,413,153 (Garwood et al) discloses a system which catalytically (or thermally) dehydrogenates the paraffins to olefins, and then reacts the olefins by catalytic oligomerization (MOGDL), in a distillate/-lube mode, to distillate range material which can be upgraded to lubes. Catalytic oligomerization in the distillate/lubes mode is a high (100–3000 psig) pressure process, whereas dehydrogenation is favored by low (less than 25 psig) pressure. Also, the dehydrogenation zone effluent is in vapor form. As a consequence a compressor is required for pressurizing the effluent to feed a catalytic oligomerization reactor zone operating the the distillate lube mode, thus resulting in expensive compression costs. Moreover, conversion of paraffins to olefins in dehydrogenation is slow, so dehydrogenation produces a dilute (20–50%) olefinic stream which requires expensive gas plant separation to recycle the paraffins back to a dehydrogenation reactor. The olefins should also be separated from paraffins prior to compressing and feeding the olefins to a higher pressure catalytic oligomerization reactor zone because only olefins oligomerize to form heavier hydrocarbons. Sending combined olefins and paraffins to the oligomerization reactor zone would increase compression costs and require larger reactors. Also, it is preferable to separate paraffins from olefins to factilitate recycle of paraffins to the dehydrogenation zone where they can be converted to olefins. However, a gas plant is required to separate paraffins from olefins because the dehydrogenation effluent stream comprises $C_4$− olefins and $C_4^-$ paraffins which are difficult to separate from one another.

It would be desirable to provide a method and apparatus for producing lubes from paraffins, such as propane and/or butane, which minimizes the problems of compression and gas plant costs and these are the problems to which the present invention is directed.

SUMMARY OF THE INVENTION

The invention minimizes the above-noted problems by adding a first lower pressure catalytic oligomerization reactor zone between the above-mentioned second higher pressure catalytic oligomerization reactor zone and the dehydrogenation zone. The lower pressure catalytic oligomerization reactor zone operates at 10–1000 psia. Its pressure should be lower than the higher pressure catalytic oligomerization reactor zone, but the actual pressure of each catalytic oligomerization reactor zone depends on a combination of operating conditions, namely, which of a number of commercially available catalysts is in each oligomerization reactor zone and the temperature, space velocity and composition of feed to each oligomerization reactor zone.

The lower pressure catalytic oligomerization reactor zone reduces compression costs by converting olefins to olefinic gasoline (330° F.− bp) which can be pumped to the higher pressure oligermization reactor as a liquid. Therefore the compressor normally required to pressurize feed to the higher pressure oligomerization reactor zone is eliminated and replaced with a lower duty compressor, and a pump to pressurize feed to the higher pressure oligomerization reactor zone.

The invention also reduces gas plant costs associated with producing lubes from $C_4^-$ paraffins because the lower pressure catalytic oligomerization reactor zone converts 85–95% of the $C_4^-$ olefins to olefinic gasoline, which is relatively easy to separate from $C_4^-$ paraffins prior to feeding to the higher pressure catalytic oligomerization reactor zone.

Accordingly, it is a primary object of this invention to provide an improved method and apparatus for converting paraffins to lubes which employs integrating dehydrogenation of propane/butane to produce olefins with a two zone oligomerization of olefins to produce heavier hydrocarbons.

It is another object of this invention to provide an improved method and apparatus for converting propane/butane to lubes which employs integrating dehydrogenation of propane/butane to produce olefins with a low pressure oligomerization of olefins and higher pressure oligomerization of olefins to produce heavier hydrocarbons which can be upgraded to lubes.

It is another object of this invention to provide a method and apparatus for converting propane/butane to lubes and facilitating recycle of paraffins to a dehydrogenation zone.

It is another object of this invention to provide a method and apparatus for converting propane/butane to lubes with reduced gas plant costs.

It is another object of this invention to provide a method and apparatus for integrating dehydrogenation of propane/butane to produce olefins with oligomerization of olefins to produce heavier hydrocarbons, which reduces the need for compressing olefins from the dehydrogenation plant prior to oligomerization.

In its method aspects, the invention achieves the foregoing objects by a method for producing heavier hydrocarbons of gasoline or distillate boiling range, which comprises the steps of passing a paraffinic feed stream comprising $C_3/C_4$, such as LPG, into a dehydrogenation zone at conditions of pressure at about 0.1–2 atms. and temperature at about 1000°–1700° F., which favor conversion of the paraffinic feed stream to an olefin rich effluent stream comprising propylene or butylene, depending on whether the feed stream is propane rich or butane rich; contacting the olefin rich effluent stream with a crystalline zeolite oligomerization catalyst in a first catalytic reactor zone at conditions of pressure at about 10–1000 psia and temperature at about 400°–800° F., which favor conversion of olefins to a first reactor effluent stream rich in olefinic gasoline range hydrocarbons; separating the first reactor effluent stream in a first separation zone to form a $C_4^-$ rich stream and a $C_5^+$ rich stream; passing the $C_5^+$ rich stream to a second catalytic reactor zone, where it contacts a crystalline zeolite oligomerization catalyst at relatively higher pressure than the first catalytic reactor zone ranging from 100–3000 psig and temperature ranging from 350°–600° F. under conditions favorable for production of a second reactor effluent stream rich in distillate; passing the second reactor effluent stream into a second separation zone, where it is separated into an olefinic gasoline stream and a distillate stream; and hydrotreating the distillate stream. The hydrotreated distillate stream may be separated in a product separation zone into products comprising lubes.

In its apparatus respects, the invention comprises: means for feeding a paraffinic feed stream comprising $C_3/C_4$, such as LPG, at conditions of 0.1–2 atm pressure and 1000°–1700° F. temperature to a dehydrogenation zone which favor conversion of the paraffinic feed stream to an olefin rich effluent stream; means for passing the paraffinic feed stream to a first catalytic reactor zone, where it contacts with a crystalline zeolite oligomerization catalyst at conditions of 10–1000 psia pressure and 400°–800° F. temperature to convert a major portion of olefins to olefinic gasoline range hydrocarbons which form a first reactor effluent stream; means for separating the first reactor effluent stream in a first separation zone to form a $C_4^-$ rich stream and a $C_5^+$ rich stream; means for passing the $C_5^+$ rich stream to the second catalytic reactor zone, where the $C_5^+$ rich stream contacts with a crystalline zeolite oligomerization catalyst at high pressure and high temperature to convert a major portion of the $C_5^+$ rich stream to distillate which leaves as a second reactor effluent stream; means for separating the second reactor effluent stream into an olefinic gasoline stream, and a distillate stream; and a hydrotreating unit for hydrotreating the distillate stream. The apparatus may further comprise a product separation zone which comprises a means for separating the hydrotreated product into products comprising lubes.

DETAILED DESCRIPTION OF THE INVENTION

Figure 1:
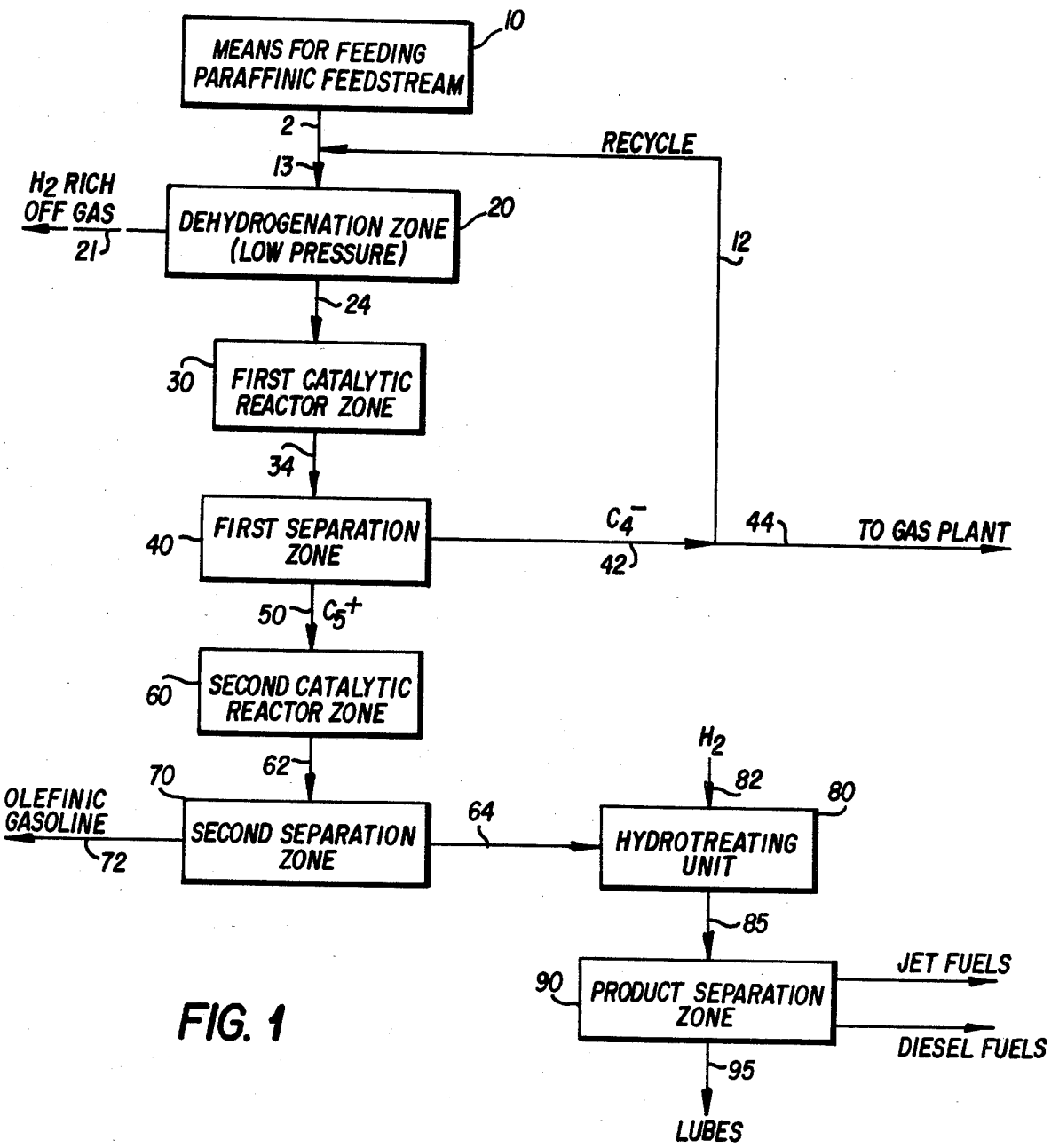
FIG. 1 is a process flow sheet showing the overall method and apparatus aspects of the invention.

The novel method and apparatus of this invention employs feeding the product from a low pressure dehydrogenation of low molecular weight paraffins, such as propane and/or butane present in LPG, into a low pressure catalytic oligomerization reactor, where the olefins produced by dehydrogenation are reacted primarily to gasoline range materials, which can then be pumped up to the pressure required for reacting to distillate in a higher pressure catalytic oligomerization reactor. The distillate is then hydrotreated and separated to recover lubes, and lighter products, such as diesel fuel or jet fuel.

In FIG. 1, the overall method and apparatus of the invention are shown in diagram form. Means 10 are provided for feeding a first paraffinic feed stream 2, comprising $C_3/C_4$ hydrocarbons, such as LPG, into a low pressure (preferred values are discussed below) dehydrogenation zone 20. Stream 2 is actually combined with a recycle $C_4^-$ rich stream 12 to form a second paraffinic feed stream 14 which passes to the dehydrogenation zone 20, which operates at low pressure and high temperature (preferred values are discussed below) to convert the second paraffinic feed stream 13 to an olefin rich effluent stream 24. The dehydrogenation zone 20 may be a catalytic dehydrogenation zone. A thermal dehydrogenation zone can also be used. Stream 24 passes into a first catalytic reactor zone 30, which operates at low pressure and high temperature (preferred values are discussed below) to convert the $C_3/C_4$ olefins to olefinic gasoline which exits as a first reactor effluent stream 34. Effluent Stream 34 enters a first separation zone 40, which forms a $C_4^-$ rich stream 42 and a $C_5^+$ rich stream 50 containing olefinic gasoline. A portion of the $C_4^-$ rich stream 42 forms a recycle $C_4^-$ rich stream 12 and is recycled to the catalytic dehydrogenation zone 20. An unrecycled portion 44 of the $C_4^-$ rich stream 42 is sent to a gas plant for separation into its components, such as $H_2$ and fuel gas. The $C_5^+$ rich stream 50 is compressed and pumped to a second catalytic reactor zone 60, where typically greater than 90% of the olefinic gasoline is converted to distillate.

Because the second catalytic reactor zone 60 receives a liquid $C_5^+$ rich stream 50, which may be easily compressed to a required pressure of the second reactor (preferably 800–2000 psig), compression costs are reduced in comparison with prior MOGD techniques, such as disclosed in U.S. Pat. No. 4,413,153 (Garwood et al), wherein a $C_3/C_4$ feed is employed. The distillate and unconverted olefins pass from the second catalytic reactor zone 60 as a second reactor effluent stream 62 into a second separation zone 70. The second separation zone 70 separates the second reactor effluent stream 62 into a distillate stream 64 and an olefinic gasoline stream 72. Portions of streams 50,72 may be recycled (not shown) to dilute the feed to the first and second catalytic reactor zones 30,60, respectively to aid in reactor temperatures control due to the exothermic nature of the oligomerization reactions in both catalytic reactor zones. The distillate stream 64 is fed to a hydrotreating unit 80 and contacted with $H_2$ from $H_2$ stream 82 and the hydrotreated distillate stream 85 feeds a product separation zone 90 to recover a lube stream 95, and other products, such as jet fuel and diesel fuel. The lube stream 95 contains 650° F.+ boiling range material.

As noted, this process reduces gas plant and compression costs for an integrated dehydrogenation/oligomerization method and apparatus by converting a major portion of the $C_3/C_4$ type olefins produced in the catalytic dehydrogenation zone 20 to olefinic gasoline in the first catalytic reactor zone 30 at low pressure. This facilitates the separation of olefinic materials from the paraffinic materials in the first separation zone 40, because it is much easier to separate the olefinic gasoline from $C_4^-$ paraffins than to separate $C_4^-$ olefins from $C_4^-$ paraffins. Therefore, the paraffinic materials are mainly removed in the $C_4^-$ rich stream 42, whereas the olefinic materials are mainly removed as olefinic gasoline.

The oligomerization catalysts preferred for use herein include crystalline alumina silicate zeolites having a silica-to-alumina ratio of at least 12, a Constraint Index of about 1 to 12 and acid cracking activity of about 160–200. Representative of suitable ZSM-5 type zeolites are ZSM-5, ZSM-11, ZSM-12, ZSM-23, ZSM-35 and ZSM-38. ZSM-5 is disclosed and claimed in U.S. Pat. No. 3,702,886 and U.S. Pat. No. Re. 29,948; ZSM-11 is disclosed and claimed in U.S. Pat. No. 3,709,979. Also see U.S. Pat. No. 3,832,449 for ZSM-12; U.S. Pat. No. 4,076,842 for ZSM-23; U.S. Pat. No. 4,016,245 for ZSM-35 and U.S. Pat. No. 4,046,849 for ZSM-38. The disclosures of the above patents are incorporated herein by reference. A suitable shape selective catalyst for a fixed bed reactor is a HZSM-5 zeolite with alumina binder in the form of cylindrical extrudates of about 1–5 millimeters. Other catalysts which may be used in one or more reactor stages include a variety of medium pore (5 to 9 Angstroms) siliceous materials, such as borosilicates, ferrosilicates and/or aluminosilicates, disclosed in U.S. Pat. Nos. 4,414,143 and 4,417,088, incorporated herein by reference.

The catalytic dehydrogenation zone 20 operating conditions will depend upon which of a number of commerically available methods is used. Typical catalytic dehydrogenation pressure and temperature conditions range from about 0.1–2 atmospheres, and 1000°–1700° F. $C_3/C_4$ paraffins can also be dehydrogenated to olefins by thermal cracking. Typically, 30–40% of the $C_3/C_4$ paraffins dehydrogenate to $C_3/C_4$ olefins, respectively, with about 10% $C_2^-$ gas made per pass through the dehydrogenation zone. Thermal cracking is carried out at a temperature of about 1400°–1700° F., at a pressure of 0–30 psig and a residence time not exceeding 1 second. Catalytic dehydrogenation is more selective to the formation of $C_3^+$ olefins than thermal dehydrogenation, which yields large amounts of ethylene. U.S. Pat. No. 4,413,153 (Garwood et al) provides more detailed information on catalytic and thermal dehydrogenation systems which can be used for zone 20.

The effect of olefin pressure on oligomerization product is significant because increased pressure results in a heavier, higher boiling range product. The first reactor zone 30 would typically operate at lower pressure and therefore make lighter products (olefinic gasoline) than the second reactor zone 60, which primarily converts light olefins and olefinic gasoline to distillate.

A suitable first catalytic reactor zone 30 would comprise a down flow reactor operating at pressures ranging from 10–1000 psia, preferably 10–40 psia, and from 400°–800° F., preferably 450°–600° F. Typical single pass conversions would be from 70–95%, and preferably 80–95%. Streams 24 and 34 would be representative of feed and product, respectively. Space velocities would range from 0.2–4 WHSV, weight hourly space velocity, and preferably 0.5–1.5 WHSV. A typical unit which can be used for the first catalytic reactor zone, is described in more detail in U.S. Pat. No. 3,960,978 and in Example 2 of U.S. Pat. No. 4,211,640 (both Givens et al).

The general operating parameters for production of lube boiling range materials (650° F.+ bp) in the second catalytic reactor zone 60 are pressures from 100–3000 psig (preferably 800–2000 psig) at room temperatures ranging from 350°–600° F., and space velocities of 0.1 to 5 WHSV. Conversion of olefinic gasoline to distillate is typically greater than 90%. A suitable system for conversion of olefins to distillate and upgrading of the distillate to recover lube oil is described in more detail in U.S. Pat. No. 4,413,153 (Garwood et al).

Distillate upgrading comprises hydrotreating and separating to form lube oil and other products. The distillate stream 64, obtained from the second separation zone 70, is subjected to hydrotreating to stabilize the distillate stream 64 by saturation of olefins and diolefins and to increase the cetane value of the distillate. Hydrogen gas may be obtained by sources such as steam reforming or hydrogen recovered from the dehydrogenation zone 20. The hydrotreating is by hydrogenation, which is a catalytic process which preferably uses a Pt or Pd supported catalyst, which does not require the addition of sulfur to maintain activity. Such a catalyst produces sulfur-free products, unlike Co/Mo/Al or Ni/W/Al catalysts. A typical catalyst is 0.4% Pt on gamma-alumina. Saturation of the olefin double bond is essentially complete under hydrogenation conditions of 550°–700° F., a pressure of 100–500 psig, and a space velocity of 0.5–5 LHSV (liquid hourly space velocity) and a hydrogen volume rate of 1000–5000 SCF/bbl. U.S. Pat. No. 4,413,153 (Garwood et al) discloses a system, for hydrotreating of distillate and separation of hydrotreated distillate by distillation to recover lubes, which can be used for unit 80. U.S. Pat. No. 4,456,781 (Marsh et al) also discloses a system, for separation of MOGD products by distillation, which can be used for zone 70.

While specific embodiments of the method and apparatus aspects of the invention have been shown and described, it should be apparent that many modifications can be made thereto without departing from the spirit and scope of the invention. Accordingly, the invention is not limited by the foregoing description, but is only limited by the scope of the claims appended hereto.

We claim:

1. A method for converting olefins by catalytic oligomerization to produce distillates and lubes which comprise the steps of:

(a) passing a paraffinic feed stream into a dehydrogenation zone at conditions of pressure and temperature which favor conversion of paraffins to an olefin rich effluent stream comprising at least one of the group consisting of propylene and butylene;

(b) contacting said olefin rich effluent stream in a first catalytic reactor zone with a crystalline zeolite oligomerization catalyst at conditions of pressure and temperature which favor conversion of olefins to a first reactor effluent stream rich in olefinic gasoline;

(c) separating said first reactor effluent stream in a first separation zone to form a $C_5+$ rich stream and a $C_4-$ rich stream;

(d) passing said $C_5+$ rich stream to a second catalytic reactor zone;

(e) contacting said $C_5+$ rich stream in said second catalytic reactor zone with a crystalline zeolite oligomerization catalyst at temperature and pressure conditions which favor production of a second reactor effluent stream which is rich in distillate;

(f) separating the second reactor effluent stream in a second separation zone to recover a olefinic gasoline stream and a distillate stream; and (g) contacting said distillate stream with hydrogen in a hydrotreating unit to produce a hydrotreated distillate stream comprising lube range hydrocarbons.

2. The method of claim 1, further comprising the step of passing said hydrotreated distillate stream to a product separation zone to recover a lubes stream.

3. The method of claim 1, comprising recycling a portion of said $C_4-$ rich stream to the dehydrogenation zone as a recycle $C_4-$ rich stream.

4. The method of claim 1, wherein each of the catalyst reactor zones comprises a fixed bed downflow pressurized reactor having a porous bed of zeolite catalyst.

5. The method of claim 1, wherein the first catalytic reactor zone is maintained at a pressure of 10–1000 psia and a temperature of 400°–800° F., and at a space velocity of 0.2–4 WHSV.

6. The method of claim 5, wherein the first catalytic reactor zone is maintained at a pressure of 10–40 psia, a temperature of 450°–600° F., and at a space velocity of 0.5–1.5 WHSV.

7. The method of claim 1, wherein the second catalytic reactor zone is maintained at a pressure of 100–3000 psig at a temperature of 350°–600° F. and a space velocity of about 0.1–5 WHSV.

8. The method of claim 7, wherein the second catalytic reactor zone is maintained at a pressure of 800–2000 psig.

9. The method of claim 1, wherein the first and second catalytic reactor zones contain at least one catalyst from the group consisting of ZSM-5, ZSM-11, ZSM-12, ZSM-23, ZSM-35 and ZSM-38.

10. The method of claim 1, wherein said dehydrogenation zone is a catalytic dehydrogenation zone.

11. The method of claim 1, wherein said dehydrogenation zone is a thermal dehydrogenation zone.

* * * * *

UNITED STATES PATENT AND TRADEMARK OFFICE

CERTIFICATE OF CORRECTION

PATENT NO. : 4,542,247

DATED : September 17, 1985

INVENTOR(S) : Clarence D. Chang, Joe E. Penick, Richard F. Socha

It is certified that error appears in the above-identified patent and that said Letters Patent is hereby corrected as shown below:

Column 2, line 24, "th" should be --the--

Column 2, line 64, "factilitate" should be --facilitate--

Column 3, line 27, "oligermizatiin" should be --oligomerization--

Column 5, line 14, "14" should be --13--

Signed and Sealed this

Thirteenth Day of January, 1987

*Attest:*

DONALD J. QUIGG

*Attesting Officer*

*Commissioner of Patents and Trademarks*